United States Patent [19]

Filsinger

[11] Patent Number: 5,074,208

[45] Date of Patent: Dec. 24, 1991

[54] SHEET-FED PRINTING PRESS

[75] Inventor: Karl-Heinz Filsinger, Wiesloch, Fed. Rep. of Germany

[73] Assignee: Heidelberger Druckmaschinen AG, Heidelberg, Fed. Rep. of Germany

[21] Appl. No.: 547,594

[22] Filed: Jul. 2, 1990

[30] Foreign Application Priority Data

Jul. 1, 1989 [DE] Fed. Rep. of Germany ..... 3921689

[51] Int. Cl.[5] ..... B41F 13/24

[52] U.S. Cl. ..... 101/232; 101/219; 101/225

[58] Field of Search ..... 101/216, 219, 224, 225, 101/226, 227, 228, 232, 142, 143, 181; 474/138, 900

[56] References Cited

U.S. PATENT DOCUMENTS

| | | | |
|---|---|---|---|
| 976,115 | 11/1910 | Bard . | |
| 1,819,743 | 8/1931 | Duncan . | |
| 4,376,531 | 3/1983 | Breunig . | |
| 4,791,869 | 12/1988 | Furukawa | 101/232 |

FOREIGN PATENT DOCUMENTS

| | | |
|---|---|---|
| 614688 | 5/1935 | Fed. Rep. of Germany . |
| 7219343 | 9/1973 | Fed. Rep. of Germany . |
| 715732 | 9/1954 | United Kingdom . |
| 742092 | 8/1957 | United Kingdom . |
| 2162243 | 1/1986 | United Kingdom . |

OTHER PUBLICATIONS

Xerox Technical Disclosure Journal, vol. 2, No. 6, Nov./Dec. 1977, "Registration and Tension Adjusting Mechanism", Schoppe et al., pp. 87, 88.

*Primary Examiner*—Edgar S. Burr
*Assistant Examiner*—Joseph R. Keating
*Attorney, Agent, or Firm*—Herbert L. Lerner; Laurence A. Greenberg

[57] ABSTRACT

A sheet-fed printing press with a sheet feeder and a printing unit traction device connecting the sheet feeder and the printing unit to one another, the traction device having a taut side and a slack side, a phase-adjustment device acting upon the traction device for changing a phase angle between an input shaft and an output shaft by means of a change in the length of the taut side, one of the shafts being assigned to the sheet feeder and the other to the printing unit, the phase-adjustment device acting between the slack side and the taut side along a substantially vertical line disposed centrally with respect to the shafts, the phase-adjustment device comprising an adjustably disposed guide for the taut side of the traction device, and a guide for the slack side of the traction device, tensioning elements acting between the taut-side guide and the slack-side guide for prestressing the slack-side guide against the slack side of the traction device, the slack-side guide together with the taut-side guide being movable along the substantially vertical line so as to effect the phase adjustment, the tensioning elements being effective in a phase wherein the traction device is disposed.

5 Claims, 4 Drawing Sheets

SHEET-FED PRINTING PRESS

The invention relates to a sheet-fed printing press with a sheet feeder and a printing unit, and, more particularly, traction means connecting the sheet feeder and the printing unit to one another, the traction means having a taut side and a slack side, a phase-adjustment device acting upon the traction means for changing a phase angle between an input shaft and an output shaft by means of a change in length of the taut side, one of the shafts being assigned to the sheet feeder and the other to the printing unit, the phase-adjustment device acting between the slack side and the taut side along a substantially vertical line disposed centrally with respect to the shafts, the phase-adjustment device comprising an adjustably disposed guide for the taut side of the traction means and a guide for the slack side of the traction means, tensioning elements acting between the taut-side guide and the slack-side guide for prestressing the slack-side guide against the slack side of the traction means, the slack-side guide together with the taut-side guide being movable along the substantially vertical line so as to effect the phase adjustment.

Especially in the case of high-speed sheet-fed printing presses, it is necessary to adjust the phase between the sheet feeder and the printing unit differently, matched to different speeds. At high speeds, there is a very great delay in the arrival of a sheet at the front lays, so that the latter may possibly not yet have been reached when it becomes time for the sheet to be aligned in transverse direction. By a change of the phase between the sheet feeder and the printing unit, however, it is possible to achieve a necessary advance in the phase of the sheet.

A phase-adjustment device required for this purpose has already become known in various forms. Reference is made, for example, to German Patent 853 906 and to German Utility Model 79 02 580.

From U.S. Pat. No. 4,791,869, there is also known a phase-adjustment device which acts upon traction means between a slack side and a taut side thereof along a substantially vertical line disposed centrally with respect to two shafts. The phase-adjustment device also has a slack-side guide, which is prestressed against the slack side by means of compression springs acting between the taut-side guide and the slack-side guide. More specifically, in this heretofore known device, a mounting part of the taut-side guide is of stepped construction on the slack side, and a mounting part of the slack-side guide is slidingly displaceably accommodated on the step of the taut-side guide. The compression springs act between the mounting part of the slack-side guide and the mounting part of the taut-side guide and, in fact, in a plane which is parallel to, yet spaced from the plane in which the traction means are disposed.

In an additionally heretofore known adjustment device (note U.S. Pat. No. 1,819,743), the slack-side guide is likewise mounted on a slidingly displaceable mounting part which, by means of compression springs, is also spaced from the mounting part on which the taut-side guide is mounted. In this regard, however, the mounting part for the slack side slides on two laterally disposed rod elements, which project from the mounting part for the taut side.

Also, in the last-mentioned phase-adjustment device, the compression springs therefor act in a plane parallel to the plane in which the traction means are disposed, the taut-side guide and the slack-side guide being also disposed in the latter plane.

The mounting parts of these conventional phase-adjustment devices consequently have to absorb a by-no-means inconsiderable tilting moment. The adjustment of the phase angle is disadvantageously influenced. Jamming effects may occur in the phase-adjustment device.

Starting from the hereinafore-described prior art, it is accordingly an object of the invention to provide a sheet-fed printing press with a phase-adjustment device which overcomes the hereinafore-mentioned disadvantages of the heretoforeknown devices of this general type and which is improved with respect to the power flow over devices of that general type in the prior art.

With the foregoing and other objects in view, there is provided, in accordance with the invention, a sheet-fed printing press with a sheet feeder and a printing unit traction means connecting the sheet feeder and the printing unit to one another, the traction means having a taut side and a slack side, a phase-adjustment device acting upon the traction means for changing a phase angle between an input shaft and an output shaft by means of a change in length of the taut side, one of the shafts being assigned to the sheet feeder and the other to the printing unit, the phase-adjustment device acting between the slack side and the taut side along a substantially vertical line disposed centrally with respect to the shafts, the phase-adjustment device comprising an adjustably disposed guide for the taut side of the traction means, and a guide for the slack side of the traction means, tensioning elements acting between the taut-side guide and the slack-side guide for prestressing the slack-side guide against the slack side of the traction means, the slack-side guide together with the taut-side guide being movable along the substantially vertical line so as to effect the phase adjustment, the tensioning elements being effective in a plane wherein the traction means are disposed.

According to the invention, the tensioning elements for the traction means, which act between the taut-side guide and the slack-side guide, are effective in the plane in which the traction means are disposed. In this construction, there is no longer any moment between the taut-side guide and the slack-side guide and the corresponding mounting parts. The phase adjustment can be effected advantageously with optimum power flow.

More specifically, it is further proposed according to the invention that the tensioning elements for the traction means be disposed between the mounting parts for the taut-side guide and the slack-side guide, and that the taut-side guide and the slack-side guide, respectively, be flanged onto the outer edges of the mounting parts. The mounting parts extend likewise in the plane of the traction means and directly parallel thereto, respectively, so that no moment with respect to the plane in which the traction-means are disposed is produced by the support or bracing of the tensioning elements. The tensioning elements are in the form of compression springs. Disposed in the compression springs is a rod element, which prevents a possible kinking of the compression springs.

It is further preferably provided that the mounting part of the slack-side guide have a guide extension which extends in a plane spaced from and parallel to the traction-means plane and accommodating a guide rod which is connected to the mounting part of the taut-side guide. The guide rod is held on a comparable extension of the taut-side guide, whereat the guide rod may also be adjustable in its length. Furthermore, in the extension of the taut-side guide, there is formed a recess with a female thread in which a spindle of a spindle drive is guided. The spindle drive serves to adjust the taut-side guide. In an adjusted or set position, the taut-side guide is fixed, i.e. not resiliently movable, to a limited extent, like the slack-side guide. An adjustment of the taut-side guide also directly causes the adjustment of the slack-side guide, which is braced thereagainst. Any slackening of the slack side, which results from a shortening of the taut side, is compensated for by the compression springs, which act between the taut-side guide and the slack-side guide.

In accordance with another feature of the invention, the traction means comprise roller elements, and the taut-side guide and the slack-side guide are formed as roller guides for the roller elements.

In accordance with a further feature of the invention, there are provided mounting parts for the taut-side and the slack-side guides, the tensioning elements being disposed between the mounting parts, and the taut-side guide and the slack-side guide, respectively, being flanged onto an outer edge of the mounting parts.

In accordance with an added feature of the invention, the mounting part of the slack-side guide comprises a guide extension disposed in another plane spaced from and parallel to the plane wherein the traction means are disposed, the other plane accommodating therein a guide rod connected to the taut-side guide.

With the foregoing and other objects in view, there is provided, in accordanace with the invention, a sheet-fed printing machine, traction means having a taut side and a slack side connecting an input shaft and an output shaft to one another, a phase-adjustment device acting upon the traction means for varying a phase angle between the shafts by means of a change in length of the taut side, the phase-adjustment device acting between the slack side and the taut side along a substantially vertical line disposed centrally with respect to the shafts, the phase-adjustment device comprising an adjustably disposed guide for the taut side of the traction means, and a guide for the slack side of the traction means, tensioning elements acting between the taut-side guide and the slack-side guide for prestressing the slack-side guide against the slack side of the traction means, the slack-side guide together with the taut-side guide being displaceable along the substantially vertical line so as to effect the phase adjustment, the tensioning elements being effective in a plane wherein the traction means are disposed.

Other features which are considered as characteristic for the invention are set forth in the appended claims.

Although the invention is illustrated and described herein as embodied in a sheet-fed printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
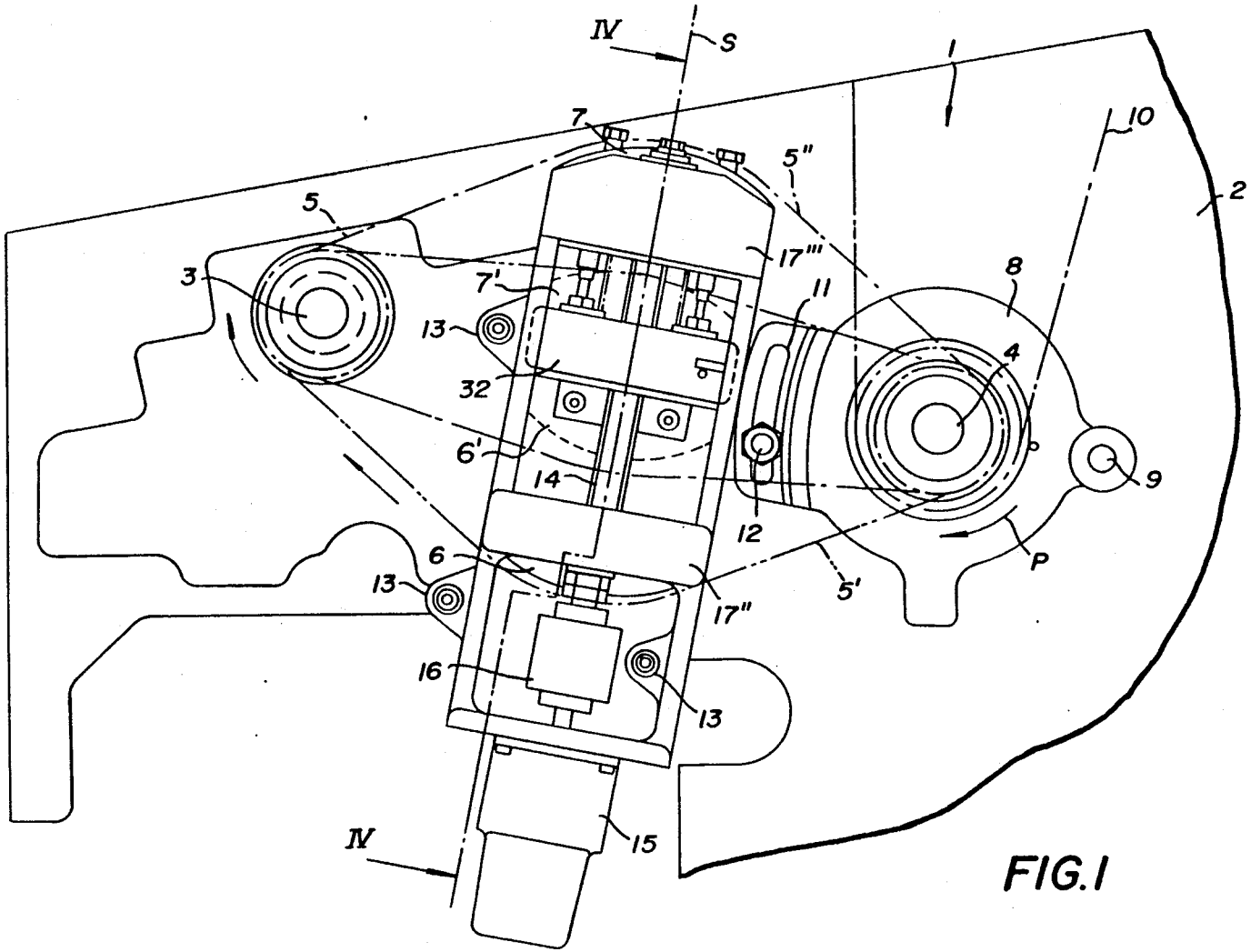
FIG. 1 is a framentary diagrammatic front elevational view of a sheet-fed printing press having a phase-adjustment device according to the invention.

Referring now more specifically to the figures of the drawing, there is shown therein a phase-adjustment device 1 for a sheet-fed printing press shown only in part. With respect to the sheet-fed printing press, only a side-wall section 2 thereof is shown, wherein a shaft 4 assigned to a non-illustrated sheet feeder, and a shaft 3 assigned to a printing unit are journalled.

The construction of a feeder and of a printing unit, which are obviously not shown in detail, are well-known in the art.

The shaft 4 is driven by the shaft 3 through the intermediary of diagrammatically represented traction means 5 such as an endless chain or belt, for example. The drive occurs in the direction of the arrow P. Accordingly, the traction means 5 have a taut side or strand 5' and a slack side or strand 5''. The phase-adjustment device 1 has a guide 6 for taut strand 5' and a guide 7 for the slack strand 5''. FIG. 1 shows the taut-side guide 6 and the slack-side guide 7, respectively, fully extended in their most widely spaced-apart positions. The guides 6 and 7 are indicated in their farthest-retracted positions 6' and 7', respectively, by broken lines. In operation, the farthest-extended position of the taut-side guide 6 in a solid line is accompanied by the farthest-retracted position 7' (broken line) of the slack-side guide 7 and, conversely, the farthest-extended position of the slack-side guide 7, which is shown by a solid line, is accompanied by the farthest retracted position 6' of the taut-side guide 6 indicated by the broken line.

The shaft 4 is rotatably journalled in a bearing 9 by means of a flange 8. This makes it possible to adjust the tension of other traction means 10. An oblong hole or slot 11 is formed in the flange 8 opposite the bearing 9. It is possible to establish a specific position of the flange 8 by means of a screw 12 extending through the side-wall section 2.

The phase-adjustment device 1 is disposed along a substantially vertical line S located centrally between the shafts 3 and 4.

Figure 4:
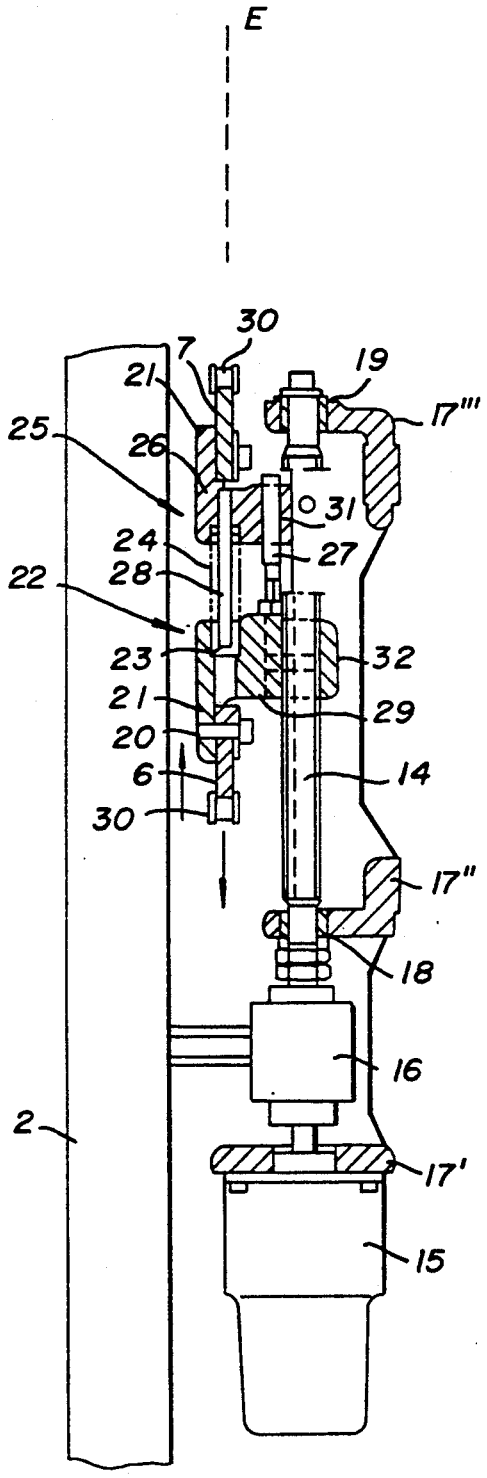
FIG. 4 is a cross-sectional view of FIG. 1 taken along the line IV—IV, in the direction of the arrows.

The phase-adjustment device 1 is, furthermore, fastened to the side-wall section 2 by bolts 13. The taut-side guide 6, as is apparent more specifically from FIG. 4, is displaceably guided on a spindle 14, which extends parallel to and spaced from a plane in which the traction means 5 are disposed. The spindle 14 is rotatable by a servo-motor 15. A coupling 16 is disposed between the spindle 14 and the servo-motor 15. The spindle 14 and the servo-motor 15 are held in a carrier part 17, which is attached to the side-wall section 2 of the sheet-fed printing press by means of the aforementioned bolts 13. More specifically, the spindle 14 is mounted two-fold at mounting points 18 and 19.

The taut-side guide 6 is fastened by bolts 20 to an outer edge 21 of a mounting part 22 for the taut side guide 6. The slack-side guide 7 is fastened in the same manner to a mounting part 25. A counter-bearing 23 for a compression spring 24 is provided in the mounting part 22, and acts between the taut-side guide 6 and the slack-side guide 7 or, more precisely, between the mounting part 22 for the taut-side guide 6 and the mounting part 25 for the slack-side guide 7. Appropriately provided in the mounting part 25 is an identical counter-bearing 26 for the compression spring 24.

Lengthwise adjustable guide rods 27 are fastened to the mounting part 22 or, more precisely, to a guide extension 32 of the latter, and have a guide extension 31 of the mounting part 25 slidingly displaceable thereon. The guide rods 27 extend at a distance from, but parallel to, a traction-means plane E in which the traction means 5 is disposed.

Figure 2:
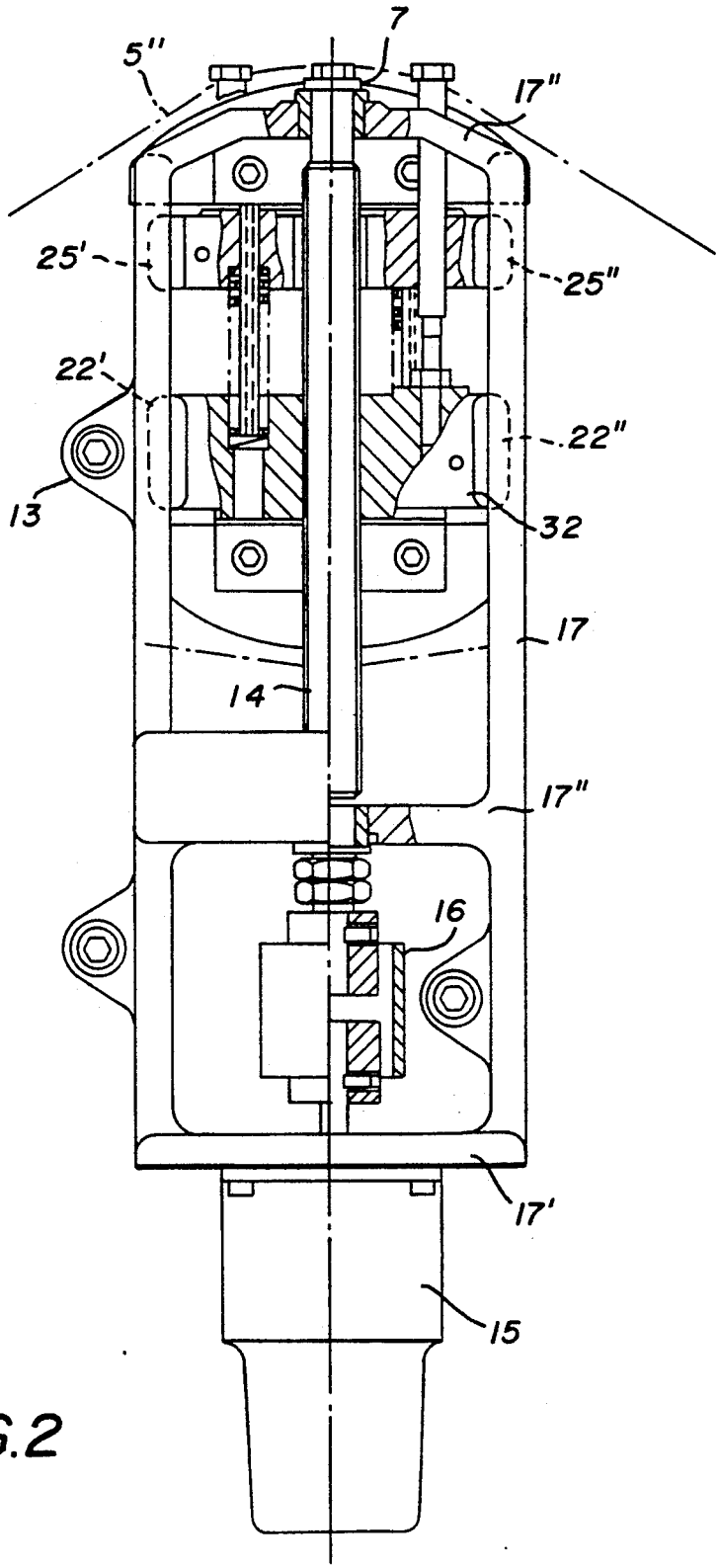
FIG. 2 is an enlarged view, partly in section, of the phase-adjustment device according to FIG. 1.
Figure 3:
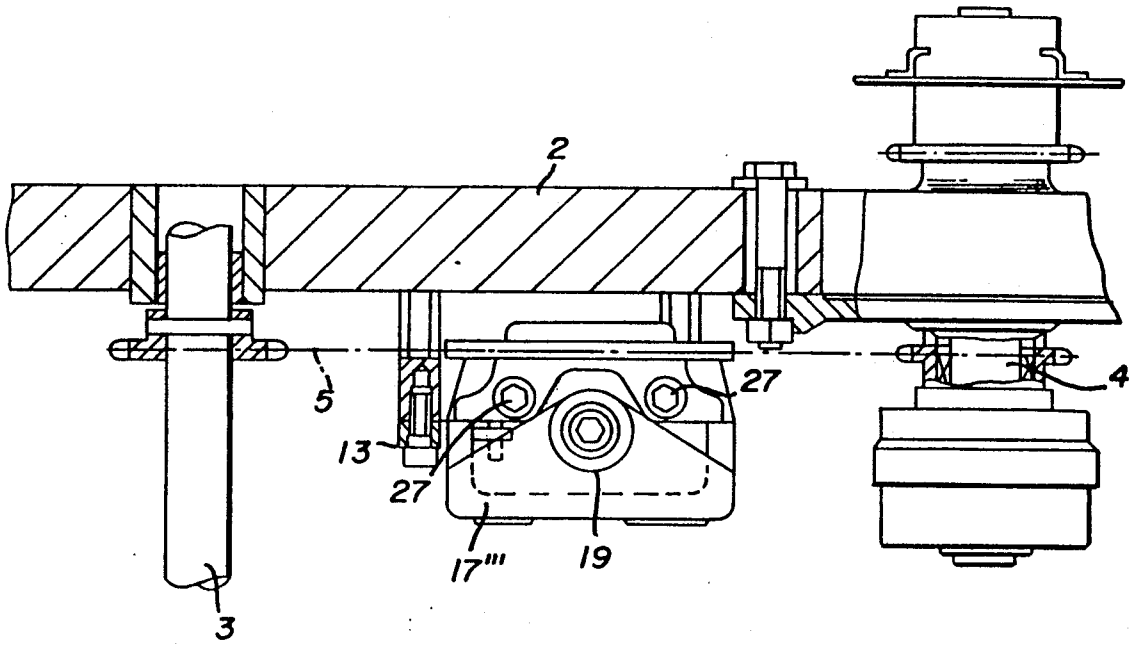
FIG. 3 is a fragmentary top plan view, partly in section and partly cut away, of FIG. 1.

It is clearly apparent from the views in FIG. 1 and FIG. 2 that two guide rods 27 and two compression springs 24, respectively, are provided.

Further disposed in each of the compression springs 24 and held in the mounting 25 for the guide 7 at the slack side 5'' is a cylindrical rod 28, which prevents any possible kinking of the compression spring 24.

The cylindrical rod 28, if necessary or desirable is able to retract into a bore 29 formed in the mounting 22.

Also apparent from FIG. 2 is the construction of the coupling 16, although it is represented only diagrammatically.

The carrier part 17, as is apparent likewise from FIG. 2, is substantially rectangular in shape. The servo-motor 15 is flanged onto a lower crosspiece or traverse 17'. A center crosspiece or traverse 17'' serves to hold or bear the spindle 14, as does also an upper crosspiece or traverse 17'''.

The mounting parts 22 and 25 have lateral guide surfaces 22', 22'' and 25', 25'', which are in contact with lateral struts or braces of the carrier part 17.

It is also apparent especially from FIG. 2 that only in the mounting part 22 for the taut-side guide 6 is a thread formed for cooperating with the spindle 14, however, the spindle 14 freely passes through the mounting part 25 for the slack-side guide 7.

The taut-side guide 6 and the slack-side guide 7 are formed as rolling guides, because, in the embodiment illustrated in FIG. 4, the traction means 5 have rollers 30 which roll on the rolling guides. The taut-side guide 6 and the slack-side guide 7 are constructed with as large a radius as possible. This permits relatively small deflections of the traction means 5 when there is a relatively large change of phase. In the farther inward positions or settings, the traction means roll only on a smaller circumferential region of the taut-side guide 6 and of the slack-side guide 7.

It is essential that the compression springs 24, which tension the traction means 5 by spacing the taut side guide 6 from the slack-side guide 7, are disposed in the traction-means plane E in which the traction means 5 are disposed. With respect to the spindle 14 and the guide rods 27, no tilting or tipping moment results from forces exerted, say, by the traction means 5 on the taut-side guide 6 and on the slack-side guide 7. While respective regions of the mounting parts 22, 25, which respectively form an outer edge 21 onto which the taut-side guide 6 and the slack-side guide 7, respectively, are flanged, extend parallel to the plane E, but are offset towards the side-wall section 2, the counter-bearings 23, 26 are so disposed in the mounting parts 22, 25 that the longitudinal axes of the compression springs 24 extend directly in plane E. The guide extension 31 of the mounting part 25 is extended on the other side of the plane E, with respect to that region of a mounting part 22, 25 which forms an outer edge 21.

When the taut-side guide 6 is adjusted by means of the spindle 14, for example, downwardly in FIG. 1, the taut side 5' of the traction means 5 is lengthened. At the same time, the shaft 4, due to the lengthening, is rotated with respect to the shaft 3 in the direction of the arrow P so that there is a change in the phase angle between the shafts 3 and 4. If the taut-side guide 6 is adjusted in the opposite direction, there is a corresponding shortening of the taut side 5', and the shaft 4 is rotated opposite to the direction of the arrow P with respect to the shaft 3.

The features of the invention disclosed in the foregoing description, and in the drawings and in the claims, hereinafter may be of significance both individually and in any desired combination with respect to the realization of the invention.

The foregoing is a description corresponding in substance to German Application P 39 21 689.6, dated July 1, 1989, the International priority of which is being claimed for the instant application, and which is hereby made part of this application. Any material discrepancies between the foregoing specification and the aforementioned corresponding German application are to be resolved in favor of the latter.

I claim:

1. Sheet-fed printing press with a sheet feeder and a printing unit having an input and an output shaft, traction means connecting the respective shafts of the sheet feeder and the printing unit to one another, the traction means having a taut side and a slack side, a phase-adjustment device acting upon the traction means for changing a phase angle between the input shaft and the output shaft by means of a change in length of the taut side, the phase-adjustment device acting between the slack side and the taut side along a substantially vertical line disposed centrally with respect to the shafts, the phase-adjustment device comprising an adjustably disposed guide for the taut side of the traction means, and a guide for the slack side of the traction means, tensioning elements disposed between said taut-side guide and said slack-side guide in a plane which bisects said slack side guide and taut side guide and comprising means for prestressing said slack-side guide against the slack side of the traction means, means for moving said slack-side guide together with said taut-side guide along the substantially vertical line so as to effect the phase adjustment.

2. Sheet-fed printing press according to claim 1, wherein the traction means comprise roller elements, and said taut-side guide and said slack-side guide are formed as roller guides for said roller elements.

3. Sheet-fed printing press according to claim 1, including mounting parts for said taut-side and said slack-side guides, the tensioning elements being disposed between said mounting parts, and means for fastening said taut-side guide and said slack-side guide, respectively, to an outer edge of said mounting parts.

4. Sheet-fed printing press according to claim 3, wherein the mounting part of said slack-side guide comprises a guide extension disposed in another plane spaced from and parallel to the plane wherein the traction means are disposed, the other plane accommodating therein a guide rod connected to said taut-side guide.

5. In a sheet-fed printing machine having an input shaft and an output shaft, traction means having a taut side and a slack side connecting the input shaft and the output shaft to one another, a phase-adjustment device acting upon the traction means for varying a phase angle between the shafts by means of a change in length of the taut side, the phase-adjustment device acting between the slack side and the taut side along a substantially vertical line disposed centrally with respect to the shafts, the phase-adjustment device comprising an adjustably disposed guide for the taut side of the traction means, and a guide for the slack side of the traction means, tensioning elements disposed between said taut-side guide and said slack-side guide in a plane which bisects said slack side guide and said taut side guide and comprising means for prestressing said slack-side guide against the slack side of the traction means, means for displacing said slack-side guide together with said taut-side guide along the substantially vertical line so as to effect the phase adjustment.

* * * * *